US010920625B2

(12) United States Patent
Schott et al.

(10) Patent No.: US 10,920,625 B2
(45) Date of Patent: Feb. 16, 2021

(54) VARIABLE VALVE DRIVE OF A COMBUSTION PISTON ENGINE

(71) Applicant: Schaeffler Technologies AG & Co. KG, Herzogenaurach (DE)

(72) Inventors: Dimitri Schott, Wachenroth (DE); Harald Elendt, Altendorf (DE); Eduard Golovatai-Schmidt, Hemhofen (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 16/628,560

(22) PCT Filed: Apr. 12, 2018

(86) PCT No.: PCT/DE2018/100343
§ 371 (c)(1),
(2) Date: Jan. 3, 2020

(87) PCT Pub. No.: WO2019/007453
PCT Pub. Date: Jan. 10, 2019

(65) Prior Publication Data

US 2020/0224560 A1 Jul. 16, 2020

(30) Foreign Application Priority Data

Jul. 5, 2017 (DE) ..... 10 2017 114 933.3

(51) Int. Cl.
*F01L 1/18* (2006.01)
*F01L 13/00* (2006.01)
(Continued)

(52) U.S. Cl.
CPC ..... *F01L 1/185* (2013.01); *F01L 13/0036* (2013.01); *F01L 1/2405* (2013.01);
(Continued)

(58) Field of Classification Search
CPC ..... F01L 1/053; F01L 1/185; F01L 1/2405; F01L 1/267; F01L 1/46; F01L 13/0005;
(Continued)

(56) References Cited

U.S. PATENT DOCUMENTS 5,544,626 A 8/1996 Diggs et al.
8,925,504 B2 * 1/2015 Tsuzuki ..... F01L 13/0021 123/90.16

(Continued)

FOREIGN PATENT DOCUMENTS

DE 10137490 A1 2/2003
DE 10212327 A1 3/2003

(Continued)

*Primary Examiner* — Devon C Kramer
*Assistant Examiner* — Kelsey L Stanek
(74) *Attorney, Agent, or Firm* — Matthew Evans

(57) ABSTRACT

The disclosure relates to a variable valve drive of a combustion piston engine with at least one gas exchange valve per cylinder, wherein each valve stroke is specified by a primary and secondary cam and transmitted to the gas exchange valve via a switchable cam follower that includes a primary lever and a secondary lever. The primary lever is in contact with the primary cam, and the secondary lever is in contact with the paired secondary cam and can be coupled to the primary lever by a coupling element. The coupling element includes a coupling pin, a locking pin, and an unlocking pin. Axially outer ends of the locking and unlocking pin protrude out of the secondary lever and are coupled to a shift rod via respective connection elements, the shift rod being longitudinally movable out of a rest position into a shift position by a linear actuator.

20 Claims, 10 Drawing Sheets

(51) Int. Cl.
*F01L 1/24* (2006.01)
*F01L 1/46* (2006.01)

(52) U.S. Cl.
CPC ..... *F01L 13/0005* (2013.01); *F01L 2001/186* (2013.01); *F01L 2001/467* (2013.01); *F01L 2013/101* (2013.01); *F01L 2305/02* (2020.05)

(58) Field of Classification Search
CPC ..... F01L 13/0036; F01L 2001/186; F01L 2800/06; F01L 2820/031
USPC ..... 123/90.16, 90.17, 90.2, 90.39, 90.41, 123/90.43, 90.44, 90.46
See application file for complete search history.

(56) References Cited

U.S. PATENT DOCUMENTS

| | | | | |
|---|---|---|---|---|
| 2003/0111031 | A1* | 6/2003 | Hendricksma ..... | F01L 13/0036 123/90.15 |
| 2012/0055428 | A1* | 3/2012 | Kidooka ..... | F01L 1/267 123/90.16 |
| 2019/0368386 | A1* | 12/2019 | Foster ..... | F01L 13/0005 |
| 2020/0025043 | A1* | 1/2020 | Schmidt ..... | F01L 1/185 |

FOREIGN PATENT DOCUMENTS

| | | | |
|---|---|---|---|
| DE | 102006023772 | A1 | 11/2007 |
| DE | 102006057894 | A1 | 6/2008 |
| DE | 102011014280 | A1 | 11/2011 |
| EP | 2662540 | A1 | 11/2013 |
| JP | 2002242628 | A | 8/2002 |
| JP | 2003293714 | A | 10/2003 |
| JP | 2004108252 | A | 4/2004 |

* cited by examiner

VARIABLE VALVE DRIVE OF A COMBUSTION PISTON ENGINE

CROSS-REFERENCE TO RELATED APPLICATIONS

This application is the U.S. National Phase of PCT Application No. PCT/DE2018/100343 filed on Apr. 12, 2018, which claims priority to DE 10 2017 114 933.3 filed on Jul. 5, 2017, the entire disclosures of which are incorporated by reference herein.

TECHNICAL FIELD

This disclosure relates to a variable valve drive of a combustion piston engine having at least one gas exchange valve with a particular function per cylinder. The valve lift of each of these gas exchange valves with a particular function is specified by at least one primary cam and one secondary cam of a camshaft and transmitted selectively to at least this gas exchange valve with the particular function by means of a switchable finger follower. The switchable finger follower has a primary lever and a secondary lever, wherein the primary lever is supported by one end thereof on an associated supporting element mounted on the housing and by the other end thereof on the valve stem of the associated gas exchange valve with the particular function. The primary lever is in contact between its two ends with the associated primary cam. The secondary lever is mounted pivotably on the primary lever and is in contact with the associated secondary cam. The secondary lever can be coupled to the primary lever by means of a coupling element that can be adjusted by means of an actuating device. The coupling element of each switchable finger follower is designed as a coupling pin, which is guided in an axially movable manner in a transverse hole of the primary lever. The coupling element can be moved into an opposite coupling hole of the secondary lever by means of a locking pin mounted in an axially movable manner in a transverse hole of the secondary lever. The coupling element can be moved back into the transverse hole of the primary lever by means of an unlocking pin guided in an axially movable manner in the coupling hole of the secondary lever.

BACKGROUND

Switchable valve drives of combustion piston engines are known in various designs. Thus, it is possible to deactivate valve drives of individual cylinders or groups of cylinders of a combustion piston engine by shutting down the transmissible valve lift and thus, in combination with a shutdown of fuel injection for the relevant cylinders, to lower fuel consumption and CO2 and pollutant emissions from the combustion piston engine in part load operation. On the other hand, the lift curves with respect to time that can be transmitted by valve drives of inlet and/or exhaust valves of a combustion piston engine can be modified by switching over the lift and thus adapted to the current operating state of the combustion piston engine in accordance with operating parameters, e.g. the engine speed and the engine load, thereby making it possible to increase the engine power and torque and to reduce the specific fuel consumption of the combustion piston engine.

In the case of valve drives that can be shut down, the usual practice in each case is to provide two components of a switchable lift transmission element which can be moved in translation or rotated relative to one another, one component of which is connected for actuation to the associated cam of a camshaft and the other component of which is connected for actuation to the valve stem of the associated gas exchange valve. Both components can be coupled to one another or decoupled from one another by means of a coupling element that is usually embodied as a coupling pin. In the coupled state, the valve lift of the associated cam is transmitted to the relevant gas exchange valve, but not in the decoupled state, with the result that the gas exchange valve then remains closed. The coupling pin is usually guided in an axially movable manner in a hole in one component and can be moved into a coupling hole of the other component. By means of a spring element, the coupling pin is held in a rest position and, when subjected to an actuating force, is moved into an actuating position and held there against the restoring force of the spring element. In the case of valve drives that can be shut down, the rest position of the coupling pin usually corresponds to the coupled state of the components of the lift transmission element and the actuating position usually corresponds to the decoupled state of the components. The lift transmission elements that can be shut down can be bucket tappets, roller tappets, rocker levers, finger followers or supporting elements.

In the case of valve drives that can be switched over, at least two components of a switchable lift transmission element that can be moved in translation or rotated relative to one another are provided in each case, of which one component is coupled to an associated primary cam of a camshaft having a defined valve lift and to a valve stem of the associated gas exchange valve and of which the other component is connected for actuation to an associated secondary cam of the camshaft with a larger valve lift or with an additional lift. Both components can be coupled to one another or decoupled from one another by means of a coupling element that is generally embodied as a coupling pin. In the decoupled state, the valve lift of the primary cam is transmitted to the relevant gas exchange valve but, in the coupled state, the respectively larger valve lift of the primary or secondary cam is transmitted to the gas exchange valve. Here too, the coupling pin is usually guided in an axially movable manner in a hole in one component and can be moved into a coupling hole of the other component. By means of a spring element, the coupling pin is held in a rest position and, when subjected to an actuating force, is moved into an actuating position and held there against the restoring force of the spring element. In the case of valve drives that can switched over, the rest position of the coupling pin generally corresponds to the decoupled state of the components of the lift transmission element and the actuating position usually corresponds to the coupled state of the components. The lift transmission elements that can be switched over are generally switchable bucket tappets, rocker levers or finger followers.

The adjustment of coupling elements of switchable lift transmission elements is usually accomplished hydraulically in that a switching pressure line leading to pressure chambers of the coupling elements is alternately connected to an oil pressure source or switched to an unpressurized state by means of a solenoid switching valve, for example. One known embodiment of a switchable finger follower which is provided in a combustion piston engine for shutting down the lift of a gas exchange valve and is provided with a hydraulically adjustable coupling pin is disclosed by DE 10 2006 057 894 A1. In contrast, DE 10 2006 023 772 A1 describes a switchable finger follower having a hydraulically adjustable coupling pin which is provided in a combustion piston engine for the purpose of switching over the lift of a gas exchange valve.

If the intention is to selectively shut down or switch over gas exchange valves of a combustion piston engine in groups, separate switching pressure lines, each having an associated switching valve, are required in the case of hydraulic adjustment of the coupling elements. A corresponding hydraulic switching device for groupwise selective adjustment of the coupling elements of a variable valve drive in a combustion piston engine having two inlet valves and two exhaust valves per cylinder is described in DE 102 12 327 A1, for example. In this case, the switchable lift transmission elements of the valve drive are designed as switchable bucket tappets.

However, the adjustment of coupling elements of switchable lift transmission elements can also be performed electromagnetically in that the coupling elements are each operatively connected to an electromagnet and the electromagnets are alternately energized or deenergized. One known embodiment of a switchable finger follower which is provided in a combustion piston engine for shutting down the lift of a gas exchange valve and is provided with an electromagnetically adjustable coupling pin can be found in U.S. Pat. No. 5,544,626 A. The coupling pin and the electromagnet, the armature of which is connected to the coupling pin, are arranged in a longitudinal alignment in the primary housing of the finger follower, thereby resulting in a larger overall length of the finger follower and a correspondingly larger width of the relevant cylinder head.

JP 2004-108 252 A discloses a variable valve drive having a series of gas exchange valves. A switchable rocker arm having coupling means extending parallel to the camshaft in the primary lever is assigned to each group of two gas exchange valves. To act upon the coupling means in the coupling direction, a central switching tube having rigid arms thereon is provided, wherein one arm in each case makes contact externally with the respective coupling means on the primary lever.

DE 101 37 490 A1 is considered to be the closest prior art. This shows a variable valve drive for switching over a lift, having a switchable finger follower, which finger follower in each case consists of a central primary lever, which is flanked on both sides by arms of a secondary lever. A continuous coupling pin is illustrated in a transverse hole of the central primary lever and can be acted upon at one end by a locking pin and at the other end by an unlocking pin, each seated in one of the arms of the secondary lever. To adjust/move the coupling pin in the direction of the coupling hole, hydraulic medium is provided, which can be passed via a supporting element in front of an outer end of the locking pin. The coupling pin is returned by the force of a compression spring, which is seated in front of an outer end of the unlocking pin.

It is noted that the arrangement of separate hydraulic switching pressure lines or electric switching lines in a cylinder head of a combustion piston engine is relatively difficult and complex owing to restricted space conditions.

SUMMARY

It is the object of the disclosure to provide a variable valve drive which is of simple construction, takes up only a little installation space and has an actuating device which acts quickly and reliably.

According to the disclosure, this object is achieved by virtue of the fact that the respective axially outer ends of the locking pin and of the unlocking pin protrude out of the secondary lever and are coupled to a switching rod via a respective rod-shaped connection element secured on said end, which switching rod is arranged above the finger follower, parallel to the associated camshaft, and is longitudinally movable out of a rest position into a shift position against the restoring force of a spring element by means of a linear actuator.

Thus, the actuating device according to the disclosure has only a single actuator, by means of which the relevant switchable finger followers can be switched over from the rest position, in which the respective secondary lever is decoupled from the associated primary lever, into the switching position in which the secondary lever is coupled to the primary lever.

The linear actuator can be arranged and secured on the cylinder head at a suitable point in the longitudinal direction of the switching rod, at which the required installation space is available and to which the power supply required for actuation can be implemented in a favorable manner. In comparison with an actuating arrangement that has separate hydraulic or electromagnetic actuators which can be arranged inside or outside the switchable finger followers, the actuating device according to the disclosure with the purely mechanically switchable finger followers has a construction which is significantly simpler and saves more installation space and which can be produced at lower cost. It is also possible to arrange several such actuating devices on the cylinder head of a combustion piston engine to enable several groups of functionally identical gas exchange valves, such as inlet valves and/or exhaust valves on all or only certain of the cylinders or, in the case of a four-valve cylinder head, of first and second inlet and/or exhaust valves, to be switched over selectively.

The linear actuator can be designed as an electromagnet with an armature guided in an axially movable manner in a coil form, wherein the armature is operatively connected by mechanical means to the switching rod. All that is then required to control and supply power to the linear actuator is a two-wire cable, which is routed from an electronic control unit to the coil of the electromagnet.

However, it is also possible for the linear actuator to be designed as a single acting hydraulic or pneumatic actuating cylinder having a piston guided in an axially movable manner in a cylinder, wherein the piston is operatively connected by mechanical means to the switching rod. In this embodiment, control and power supply to the linear actuator requires an actuating pressure line connected to the pressure chamber of the actuating cylinder, said line being connectable either to a pressure supply line connected to a pressure medium source or to an unpressurized return or vent line via a 3/2-way solenoid switching valve connected to an electronic control unit, for example.

The switching rod can be designed as a flat rod, one of the two wider outer sides of which is arranged to face the coupling pins of the switchable finger followers. By virtue of the wider outer sides and the alignment thereof, the switching rod has sufficient installation space for the mechanical coupling of the rod-shaped connection elements of the switchable finger followers. Moreover, this gives rise to the possibility of producing the switching rod in a simple and low-cost manner as a punched component from a steel or light metal sheet.

The connection elements of each switchable finger follower can be designed as leaf springs, which are each secured in a largely rigid manner on the outer end of the associated locking pin or unlocking pin and each engage in a slot-shaped opening in the switching rod. In this way, the switchover of the finger followers to coupling of the respective secondary levers to the associated primary levers and to decoupling of the secondary levers from the primary levers can be initiated at any time by an axial movement of the switching rod independently of the current rotational position of the associated camshaft.

At those finger followers, the secondary cams of which are currently being contacted on the base circle radius by the secondary levers, the switchover of the finger followers takes place immediately. At those finger followers, the primary and secondary cams of which are currently being contacted outside the base circle radius, the relevant leaf springs are initially preloaded in the switching direction or counter to the switching direction. The switchover of the relevant finger followers then takes place when the associated cams are being contacted on the base circle radius by virtue of a corresponding rotation of the camshaft.

In order to ensure simple assembly, provision is made for the leaf springs each to be secured on the locking or unlocking pin in the manner of a retaining washer in each case by mounting and engagement of an open-ended hole in an annular groove formed in the outer end of the respective locking pin or unlocking pin.

To produce the desired actuating forces by means of the respective preloading of the leaf springs, the axial spacing of the openings in the switching rod corresponds to the axial spacing between the annular grooves in the respective locking pin and the associated unlocking pin when they are resting on the coupling pin.

To compensate for the tilting movements of the finger followers and for manufacturing tolerances, the transverse dimensions and longitudinal dimensions of the openings in the switching rod are larger than the width and the thickness of the leaf springs. During the operation of the combustion piston engine, the leaf springs can thus move with little wear in the openings of the switching rod. Manufacturing tolerances in the arrangement of the openings in the switching rod and of the switching rod as a whole can thereby be compensated in a simple manner by means of an extended actuating travel of the linear actuator. The actuating device according to the disclosure thus makes relatively low demands on accuracy during manufacture and on the arrangement of the components and can therefore be produced at particularly low cost.

The switching rod is provided on its wider outer side facing away from the finger followers with an arcuate spring clip on the switching-direction side, at least at each opening for the leaf springs associated with the locking pins, the free end of which spring clip projects in the longitudinal direction into the relevant opening to provide elastic support for the associated leaf spring. The leaf springs are thereby supported elastically and with the possibility of longitudinal movement in the openings of the switching rod, as a result of which mechanical wear on the contact surfaces is reduced and the transmission of transverse forces to the locking pins of the finger followers is avoided.

In order to avoid drifting or buckling of the switching rod under load, the switching rod is guided in an axially movable manner in a plurality of guide openings, fixed with respect to the housing, of the cylinder head. At least some of the guide openings for the switching rod are arranged in bearing covers of the associated camshaft, as a result of which the production thereof is greatly simplified as compared with arrangement in cylinder head lands fixed with respect to the housing.

BRIEF DESCRIPTION OF THE DRAWINGS

Further features of the disclosure will become apparent from the following description and the figures. In the drawings.

DETAILED DESCRIPTION

Figure 1:
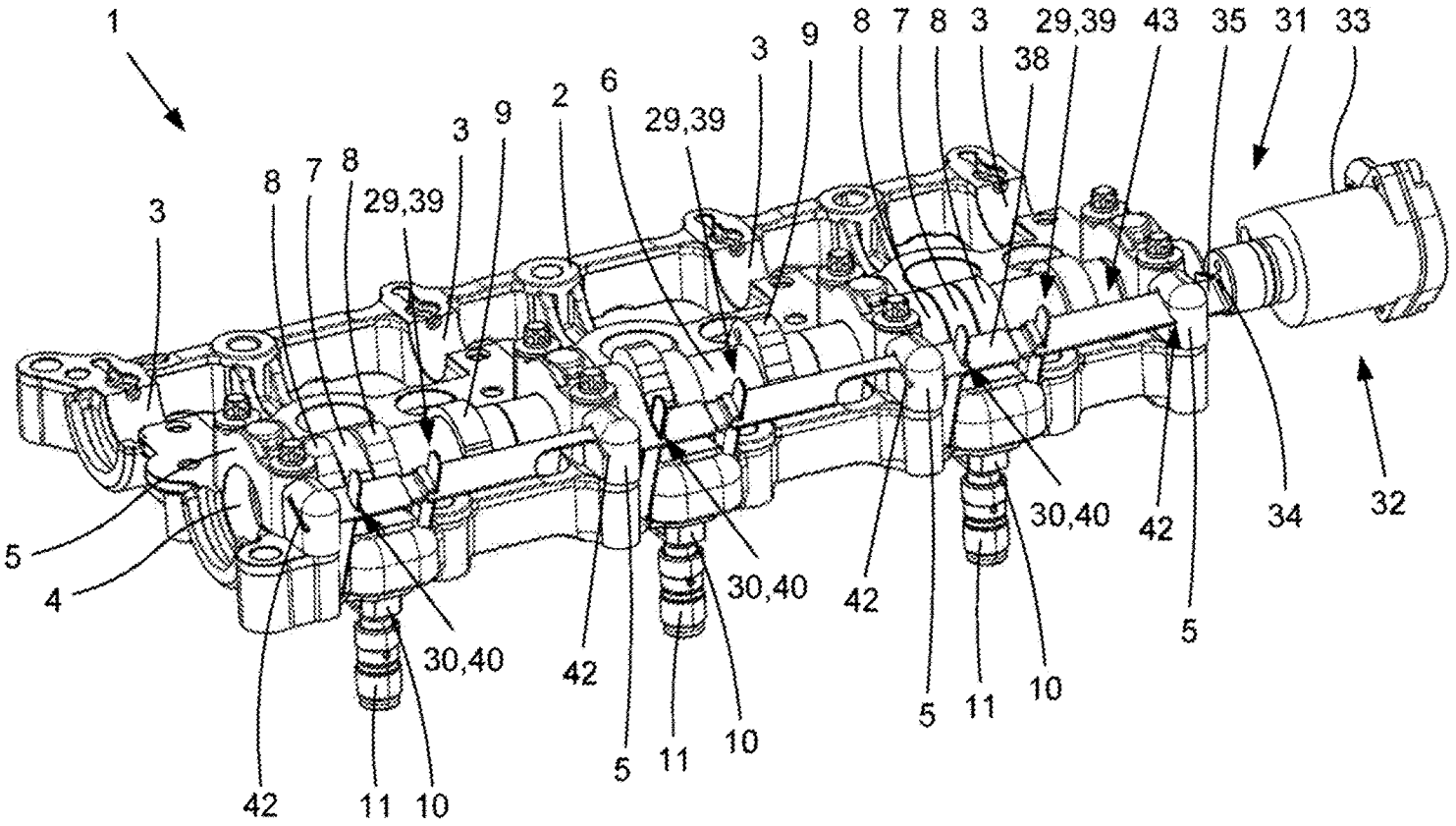
FIG. 1 shows an embodiment of a valve drive according to the disclosure for a combustion piston engine having three cylinders and four gas exchange valves per cylinder and having three switchable finger followers in the state in which they are not switched over, in a perspective overview.

In the perspective overview in FIG. 1, part of a valve drive 1 of a combustion piston engine having three cylinders arranged in series and two inlet valves and two exhaust valves per cylinder is depicted insofar as required to explain the disclosure. A camshaft support 2 of a two-part cylinder head of the combustion piston engine has four semicircular first sliding bearing sections 3 for supporting an inlet camshaft (not shown) and four semicircular second sliding bearing sections 4 for supporting an exhaust camshaft 6. The remaining sliding bearing sections for supporting the inlet camshaft and the exhaust camshaft 6 are each part of bearing covers 5, which are placed on and screwed to the camshaft support 2 after the insertion of the camshafts. In FIG. 1, only the bearing covers 5 of the exhaust camshaft 6 are depicted.

Whereas the first exhaust valves (not shown) of each cylinder can be switched over in respect of their transmissible lift curve by means of associated switchable finger followers 10, the second exhaust valves (likewise not shown) of each cylinder have constant lift transmission via associated non-switchable finger followers. For this purpose, the exhaust camshaft 6 in each case has a centrally arranged primary cam 7 and two secondary cams 8 arranged on each side of the primary cam 7 for the first exhaust valves. In contrast, the exhaust camshaft 6 has just one single cam 9 in each case for the second exhaust valves.

The non-switchable finger followers that are not shown are each supported on the underside thereof, at the end, on a supporting element mounted on the housing and having an integrated hydraulic valve lash compensating element and, at the opposite end, are supported on the valve stem of the associated second exhaust valve and, in between, are in each case in contact on their upper side with the associated cam 9. When the exhaust camshaft 6 rotates, the lift curve of the relevant cams 9 is thus transmitted to the second exhaust valves via the non-switchable finger followers.

Figure 1A:
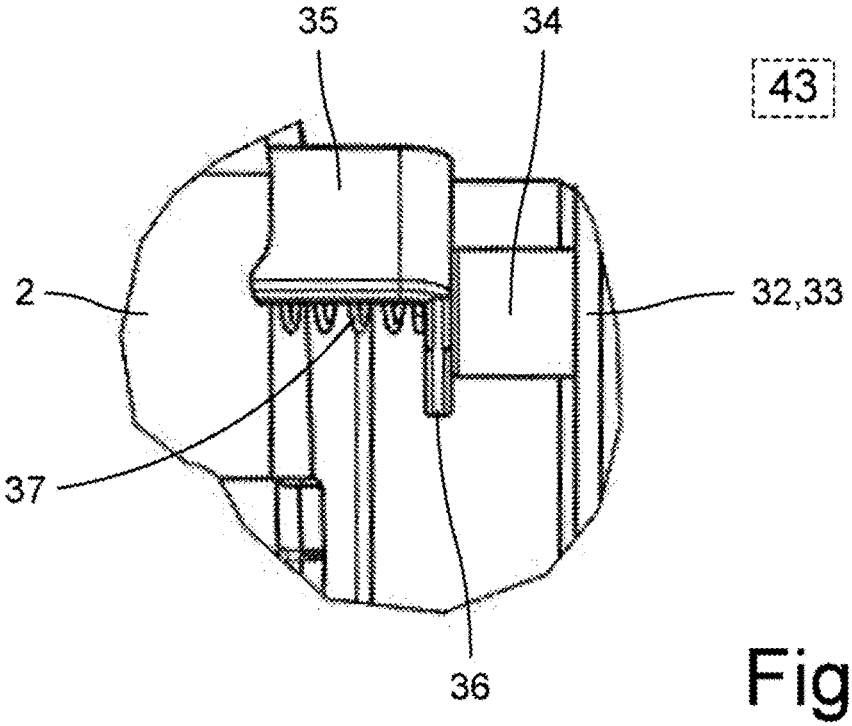
FIG. 1*a* shows a detail of the valve drive in FIG. 1 comprising a side view of a switching rod in the state in which it is not switched over.
Figure 1B:
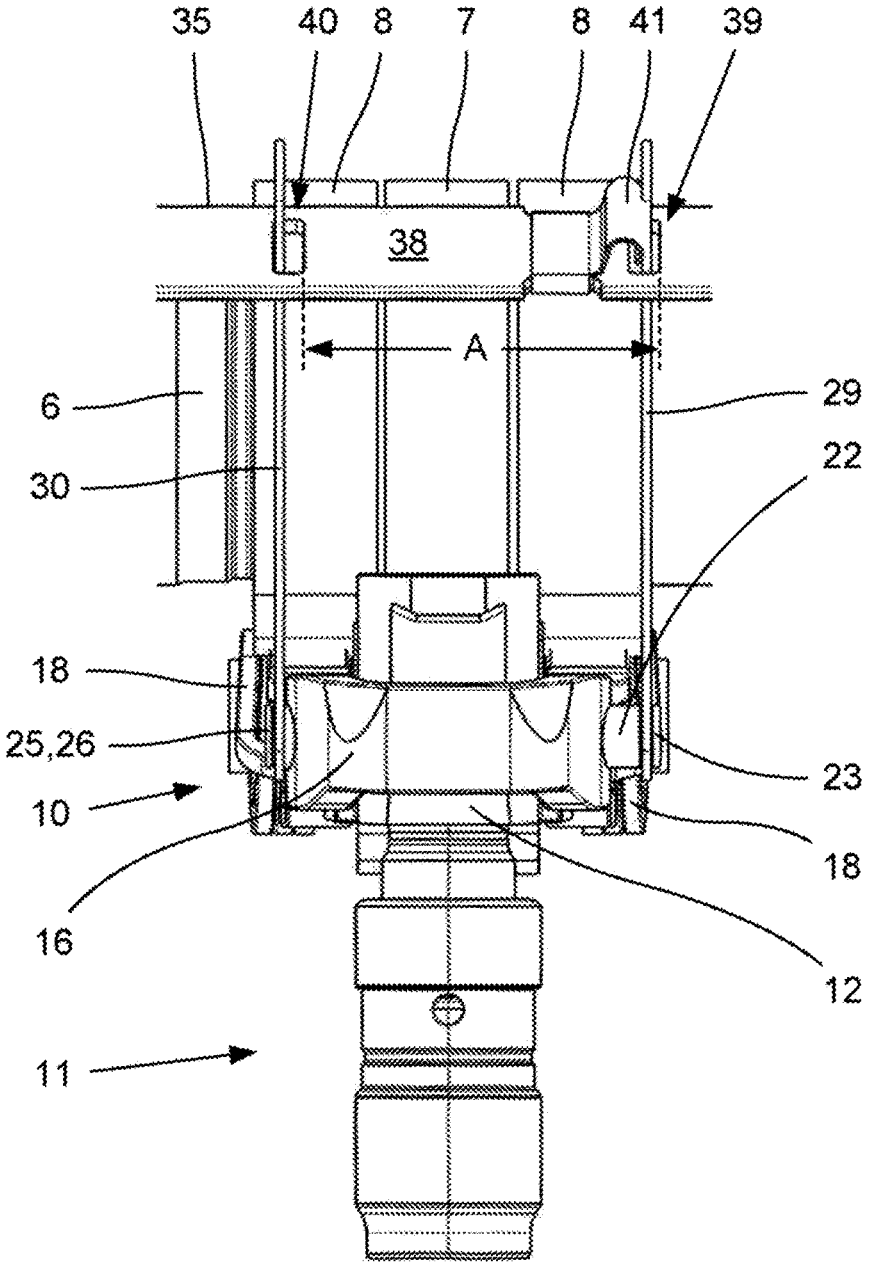
FIG. 1*b* shows a detail of the valve drive in FIG. 1 comprising a lengthwise view of a switchable finger follower in the state in which it is not switched over.
Figure 1C:
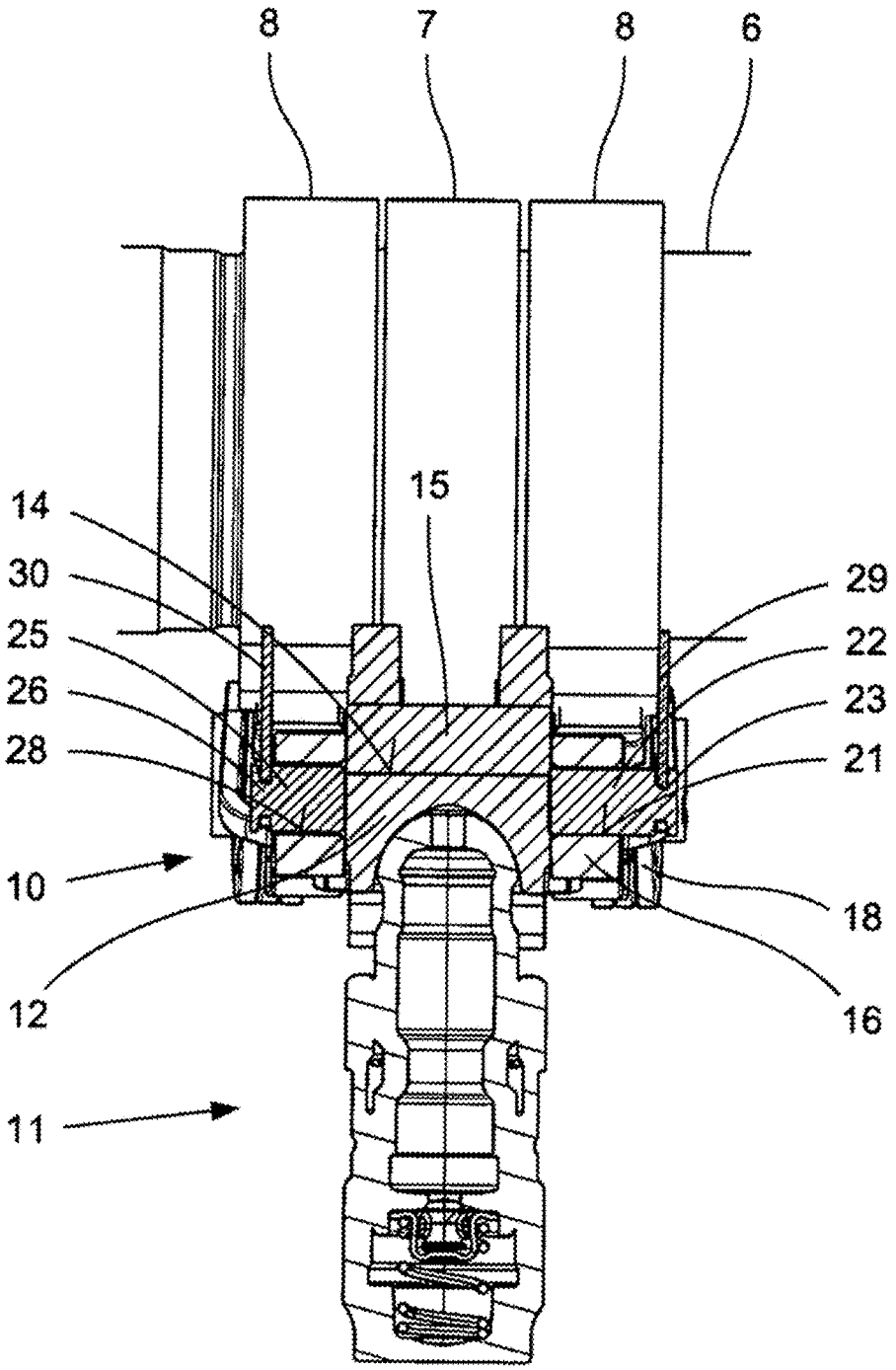
FIG. 1*c* shows a detail of the valve drive in FIG. 1 comprising a cross-sectional view of a switchable finger follower in the state in which it is not switched over.
Figure 1D:
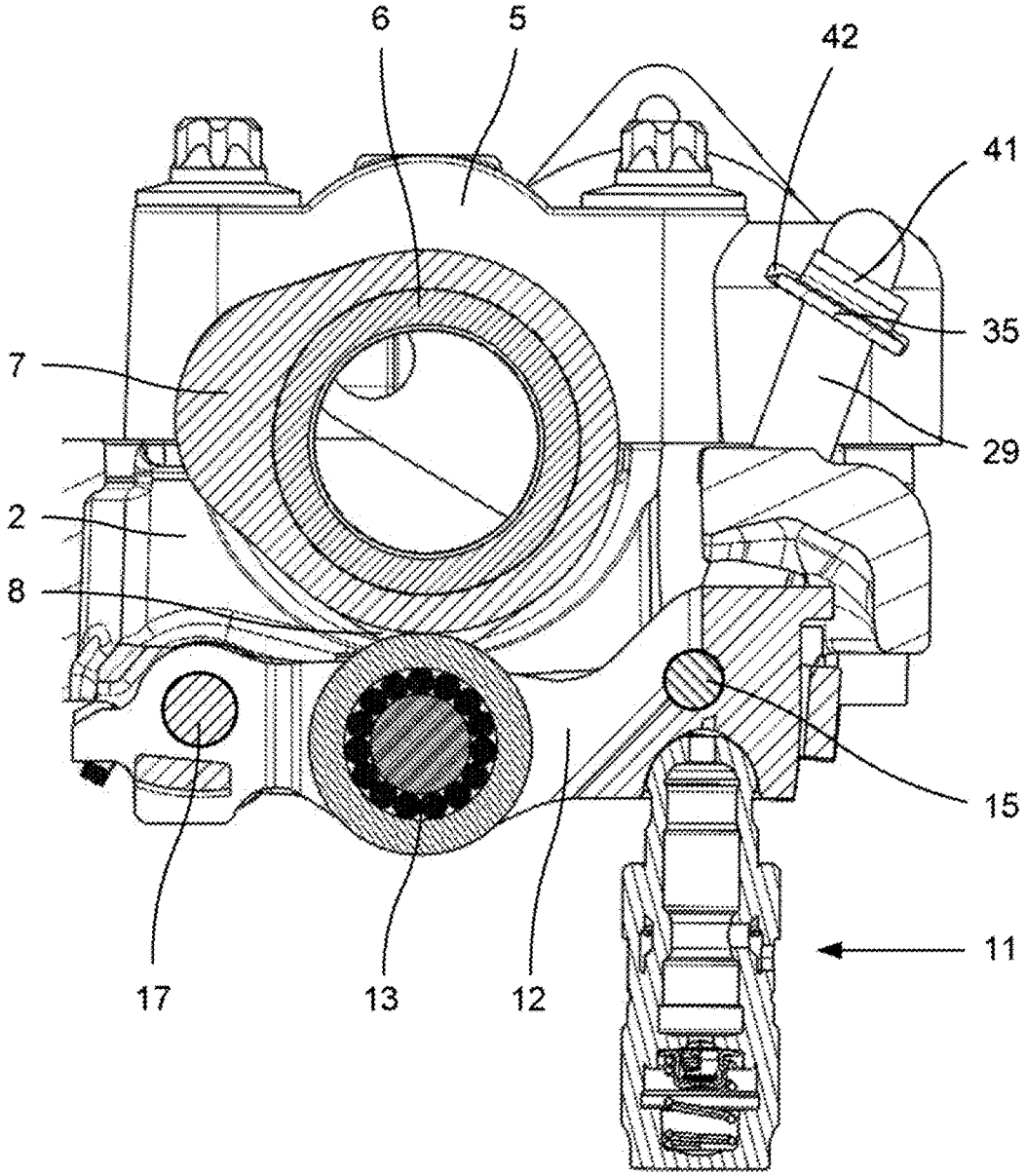
FIG. 1*d* shows a detail of the valve drive in FIG. 1 comprising a longitudinally sectioned view of a switchable finger follower in the state in which it is not switched over.
Figure 3A:
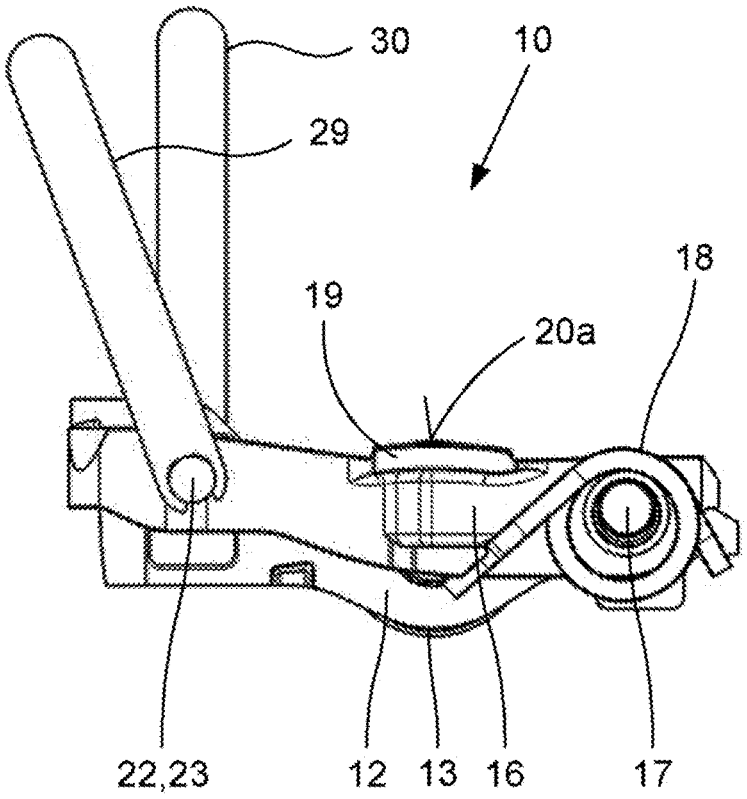
FIG. 3*a* shows a switchable finger follower of the valve drive shown in FIGS. 1 to 2*d* in a side view.
Figure 3B:
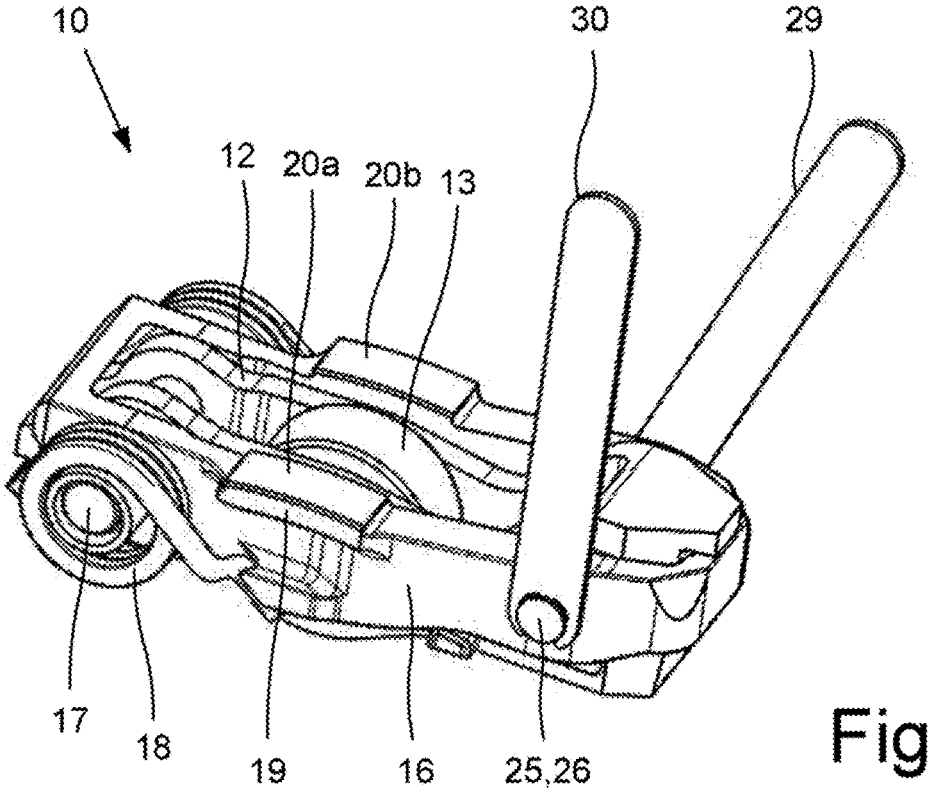
FIG. 3*b* shows the switchable finger follower of the valve drive shown in FIGS. 1 to 2*d* in an oblique perspective view.

As can be seen in the detail side view in FIG. 1*a*, the lengthwise, cross-sectional and longitudinally sectioned views in FIG. 1*b* to FIG. 1*d* as well as in the side view in FIG. 3*a* and the oblique perspective view in FIG. 3*b*, the switchable finger followers 10 each have a primary lever 12 and a secondary lever 16. The primary lever 12 is of largely frame-shaped design and is supported on its underside, at the end, on a supporting element 11 mounted on the housing and having an integrated hydraulic valve lash compensating element and, at the opposite end, is supported on the valve stem of the associated first exhaust valve. On its upper side, the primary lever 12 is in contact with the associated primary cam 7 via a contact element 13, which in the present case is designed as a rotatably mounted roller. The secondary lever 16 has a frame-shaped form surrounding the primary lever 12 and it is mounted pivotably on the primary lever 12 by means of a pivot pin 17 arranged on the valve end. As contact elements 19, the secondary lever 16 has respective widened web sections on each side, comprising respective outer sliding surfaces 20*a*, 20*b*, which come into contact with the cam region of the two secondary cams 8. Outside this cam region, i.e. in the base circle region of the secondary cams 8, the secondary lever 16 has no contact with the secondary cams 8. In this base circle region of the secondary cams 8, the end of the secondary lever 16 remote from the pivoting axis is pressed against a stop on the primary lever 12 by the spring force of a contact pressure spring 18 designed as a leg spring.

A coupling pin 15 guided in an axially movable manner in a transverse hole 14 of the primary lever 12 is part of a coupling assembly for connecting the secondary lever 16 positively to the primary lever 12. The coupling pin 15 can be moved into an opposite coupling hole 28 in the secondary lever 16 by means of a locking pin 22 mounted in an axially movable manner in a transverse hole 21 in the secondary lever 16. In a locking position of the locking pin 22, said pin, together with the coupling pin 15, accordingly locks the primary lever 12 and the secondary lever 16 to one another. Moreover, the coupling pin 15 can be moved back into the transverse hole 14 of the primary lever 12 by means of an unlocking pin 25 guided in an axially movable manner in the coupling hole 28 of the secondary lever 16.

The outer end 23 of the locking pin 22 projects axially from the secondary lever 16 and, at said secondary lever, the pin is connected for actuation to a switching rod 35 of an actuating device 31 by means of an upward-oriented rod-shaped connection element 29. In the same way, the outer end 26 of the unlocking pin 25 projects from the secondary lever 16 and, at said secondary lever, the pin is connected for actuation to the switching rod 35 of the actuating device 31 by means of an upward-oriented rod-shaped connection element 30.

In the present case, the connection elements 29, 30 of the switchable finger followers 10 are designed as leaf springs and are secured on the locking or unlocking pin 22, 25 in a way not fully visible in the manner of a retaining washer in each case by mounting and engagement with an open-ended hole in an annular groove arranged at the outer end 23, 26 of the respective locking pin 22 or unlocking pin 25.

Figure 2A:
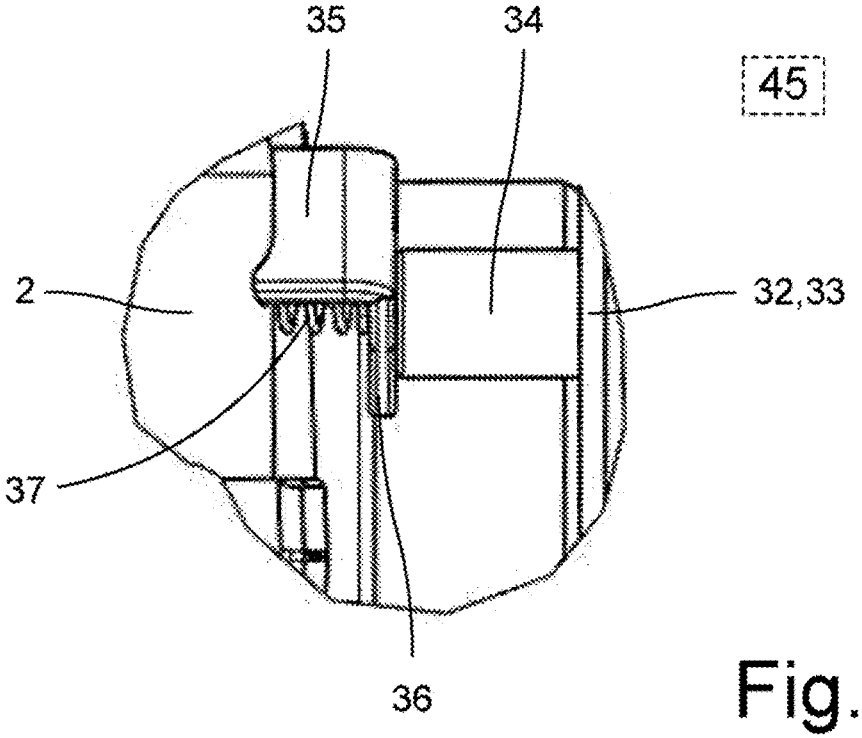
FIG. 2*a* shows a detail of the valve drive in FIG. 2 comprising a side view of a switching rod in the state in which it is switched over.
Figure 2:
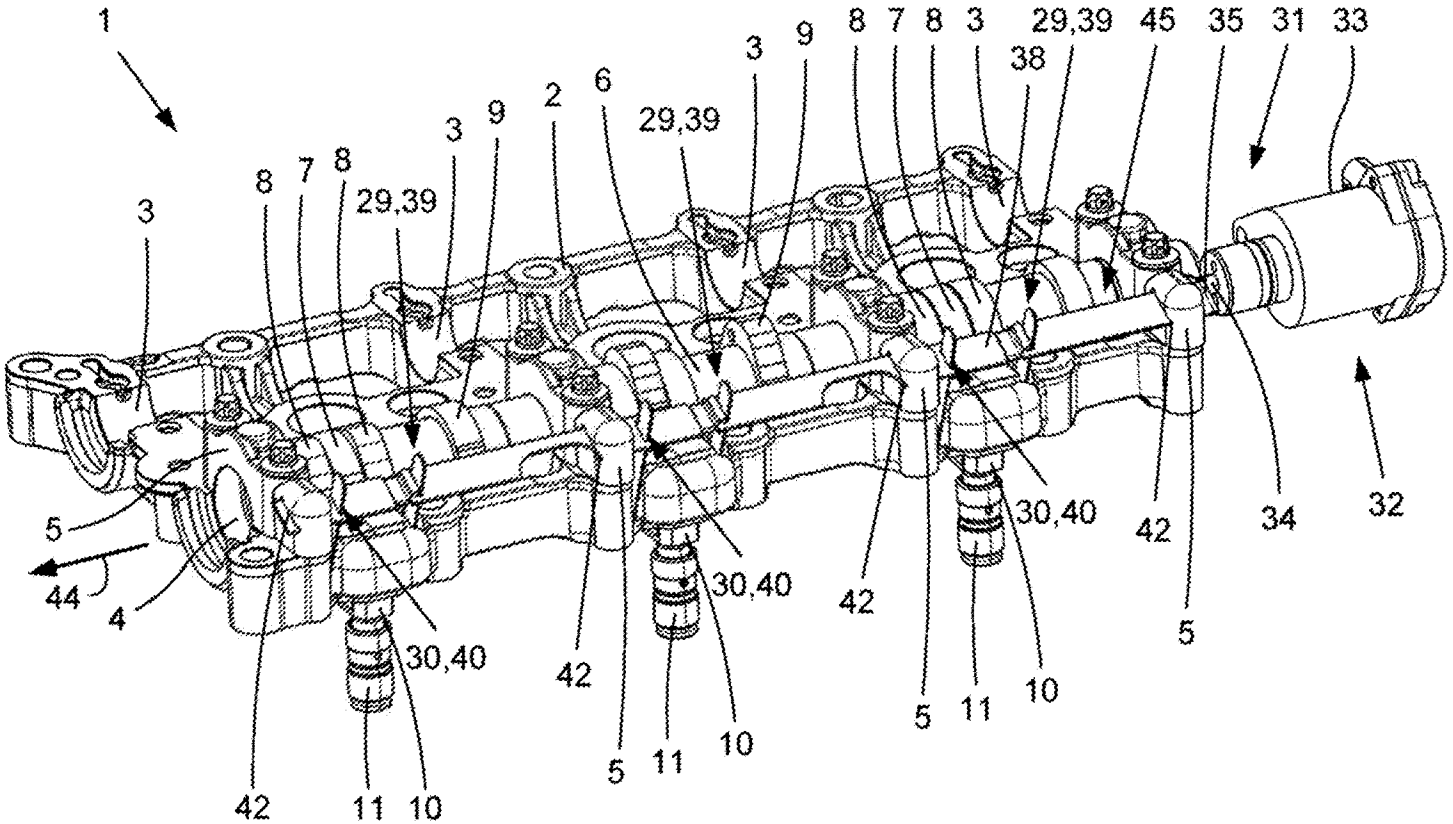
FIG. 2 shows the valve drive according to the disclosure for a combustion piston engine as per FIG. 1 having the three switchable finger followers in the switched over state, in a perspective overview.

The switching rod 35 of the actuating device 31 is arranged above the finger follower 10, parallel to the exhaust camshaft 6, and can be moved longitudinally out of a rest position 43 into a switching position 45 by means of a linear actuator 32 against the restoring force of a spring element 37 (compare FIG. 1 with FIG. 2). From the detail side view in FIG. 1*a*, it can be seen that the spring element 37 is designed as a helical spring, which is arranged between the angled, tab-shaped end 36 of the switching rod 35 and the adjacent end wall of the camshaft support 2. Here, the switching rod 35 is not connected rigidly to the armature 34; on the contrary, the switching rod 35 is pressed axially against the armature 34 by the spring element 37. This has the advantage that the armature 34 or the linear actuator 32 can be arranged where there is installation space. Accordingly, the switching rod 35 and the armature 35 do not have to be arranged coaxially with one another but merely largely axially parallel. Here, force transmission from the armature 34 to the switching rod 35 takes place via the angled, tab-shaped end 36 of the switching rod 35. By way of example, the linear actuator 32 is designed as an electromagnet with an armature 34 which is guided in an axially movable manner in a coil form 33 and the armature 34 of which is, as mentioned, operatively connected by mechanical means to the switching rod 35.

In the present case, the switching rod 35 is designed as a flat rod, one of the two wider outer sides 38 of which is arranged to face the coupling pin 15 of the switchable finger follower 10 and which can be produced as a punched component from a steel or light metal sheet. The switching rod 35 is arranged in an axially movable manner in a plurality of guide openings 42, fixed with respect to the housing, of the camshaft support 2, which in the present case are formed in the bearing covers 5 of the exhaust camshaft 6.

The connection elements 29, 30, designed as leaf springs, of the switchable finger followers 10 each engage with play in a slot-shaped opening 39, 40 of the switching rod 35, the axial spacing A of which in the switching rod 35 corresponds to the spacing of the fastening of the leaf springs 29, 30 on the locking pin 22 and the unlocking pin 25 when resting on the coupling pin 15. The transverse and longitudinal dimensions of the slot-shaped openings 39, 40 are larger than the width and the thickness of the leaf springs 29, 30. As a result, the leaf springs 29, 30 can move with little wear in the openings 39, 40 of the switching rod 35 during the operation of the combustion piston engine. Moreover, manufacturing tolerances in the formation of the openings 39, 40 in the switching rod 35 and of the switching rod 35 as a whole can thereby be compensated in a simple manner by means of an extended actuating travel of the linear actuator 32.

The switching rod 35 is provided on its wider outer wall 38 facing away from the finger followers 10 with an arcuate spring clip 41 on the switching-direction side, at each opening 39 for the leaf springs 29 of the locking pins 22, the free end of which spring clip projects in the longitudinal direction into the relevant opening 39 to provide elastic support for the associated leaf spring 29. The leaf springs 29 are thereby supported elastically and with the possibility of longitudinal movement in the openings 39 of the switching rod 35, as a result of which mechanical wear on the contact surfaces is reduced and the transmission of transverse forces to the locking pins 22 of the switchable finger followers 10 is avoided.

In FIG. 1 and FIG. 1*a*, the switching rod 35 of the actuating device 31 is depicted in its rest position 43, in which the secondary levers 16 of the switchable finger followers 10 are decoupled from the primary levers 12. This decoupled switching state of a switchable finger follower 10, which is also illustrated in the lengthwise view in FIG. 1*b* and in which the coupling pin 15 is completely within the transverse hole 14 of the primary lever 12, is particularly clearly visible in the cross-sectional view in FIG. 1*c*. In the decoupled state of the primary lever 12 and of the secondary lever 16, only the lift curve of the relevant primary cam 7 is transmitted to the associated first exhaust valve via the primary lever 12 of the switchable finger follower 10 when the exhaust camshaft 6 rotates. The lift curve of the relevant secondary cams 8 then merely causes deflection of the secondary lever 16 in relation to the primary lever 12. This can be seen particularly clearly in the longitudinally sectioned view in FIG. 1*d*, in which the primary cam 7 of the exhaust camshaft 6 is currently being contacted by the roller 13 of the primary lever 12 on the base circle radius, and the secondary cams 8 of the exhaust camshaft 6 are currently being contacted by the sliding surfaces 20*a*, 20*b* of the web sections 19 of the secondary lever 16 in the region of an additional lift cam.

In the perspective overview in FIG. 2 and the detail side view in FIG. 2*a*, the switching rod 35 of the actuating device 31 is depicted in its switching position 45, in which it is moved by an actuation of the linear actuator 32 in the switching direction indicated by a direction arrow 44. In the switching position 45 of the switching rod 35, the coupling pins 15 of those finger followers 10, the secondary cams 8 of which are currently being contacted on the base circle radius, are immediately moved into the associated coupling hole 28 of the secondary lever 16 by means of the respective leaf springs 29 and the relevant locking pins 22 since the transverse hole 21 and the coupling hole 28 of the secondary lever 16 are then in alignment with the transverse hole 14 of the primary lever 12. The secondary levers 16 of the relevant finger followers 10 are then coupled to the associated primary levers 12.

In the case of those finger followers 10, the primary or secondary cams 7, 8 of which are currently being contacted outside the base circle radius by the roller 13 of the primary lever 12 or the sliding surfaces 20 of the web sections 19 of the secondary lever 16, there is initially only axial preloading of the locking pins 22 in the direction of the coupling pins 15 by means of the leaf springs 29. The relevant coupling pins 15 are then moved by means of the respective leaf springs 29 and the locking pins 22 into the coupling hole 28 of the secondary lever 16 if the primary and secondary cams 7, 8 associated therewith are being contacted on the base circle radius.

Figure 2B:
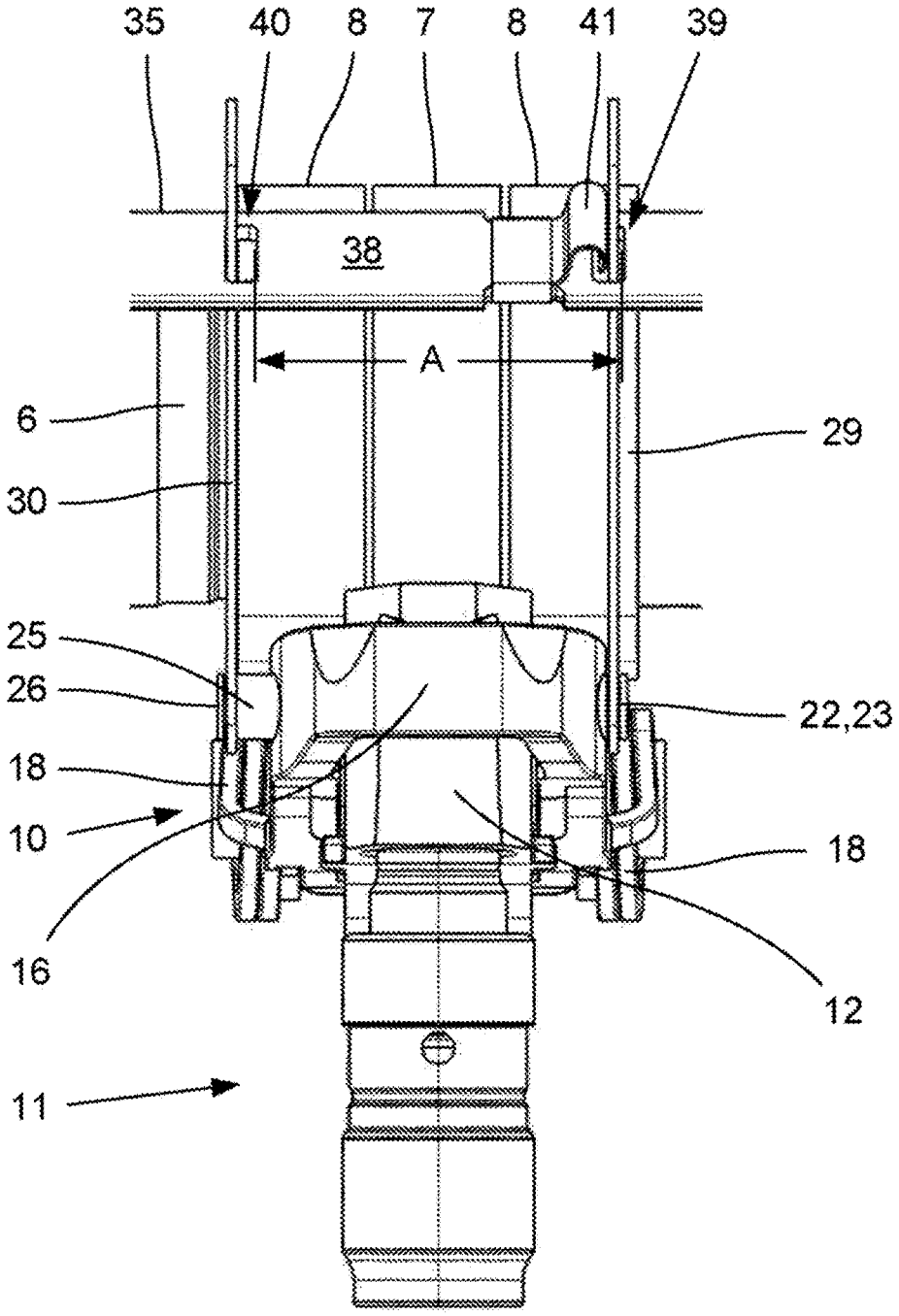
FIG. 2*b* shows a detail of the valve drive in FIG. 2 comprising a lengthwise view of a switchable finger follower in the state in which it is switched over.
Figure 2C:
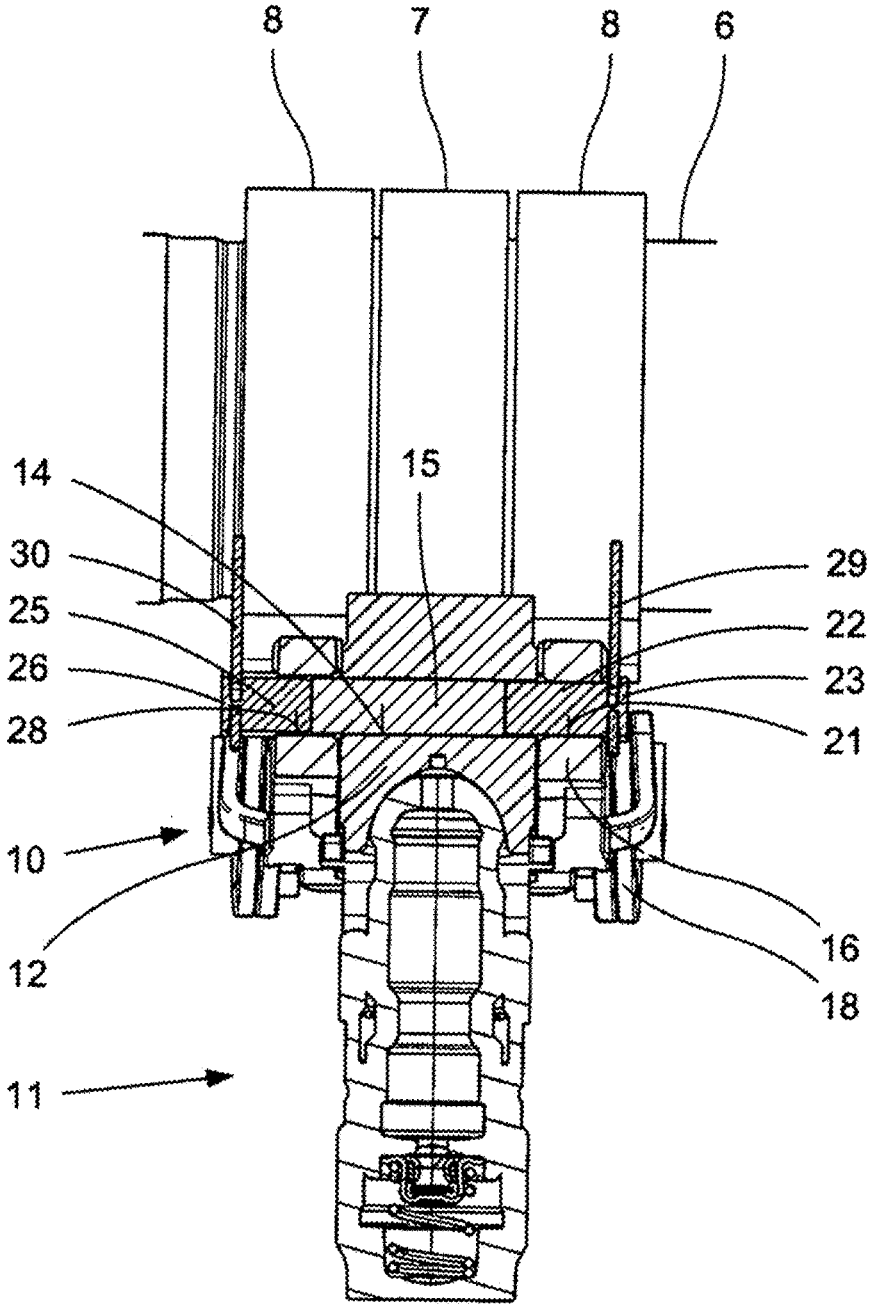
FIG. 2*c* shows a detail of the valve drive in FIG. 2 comprising a cross-sectional view of a switchable finger follower in the state in which it is switched over.
Figure 2D:
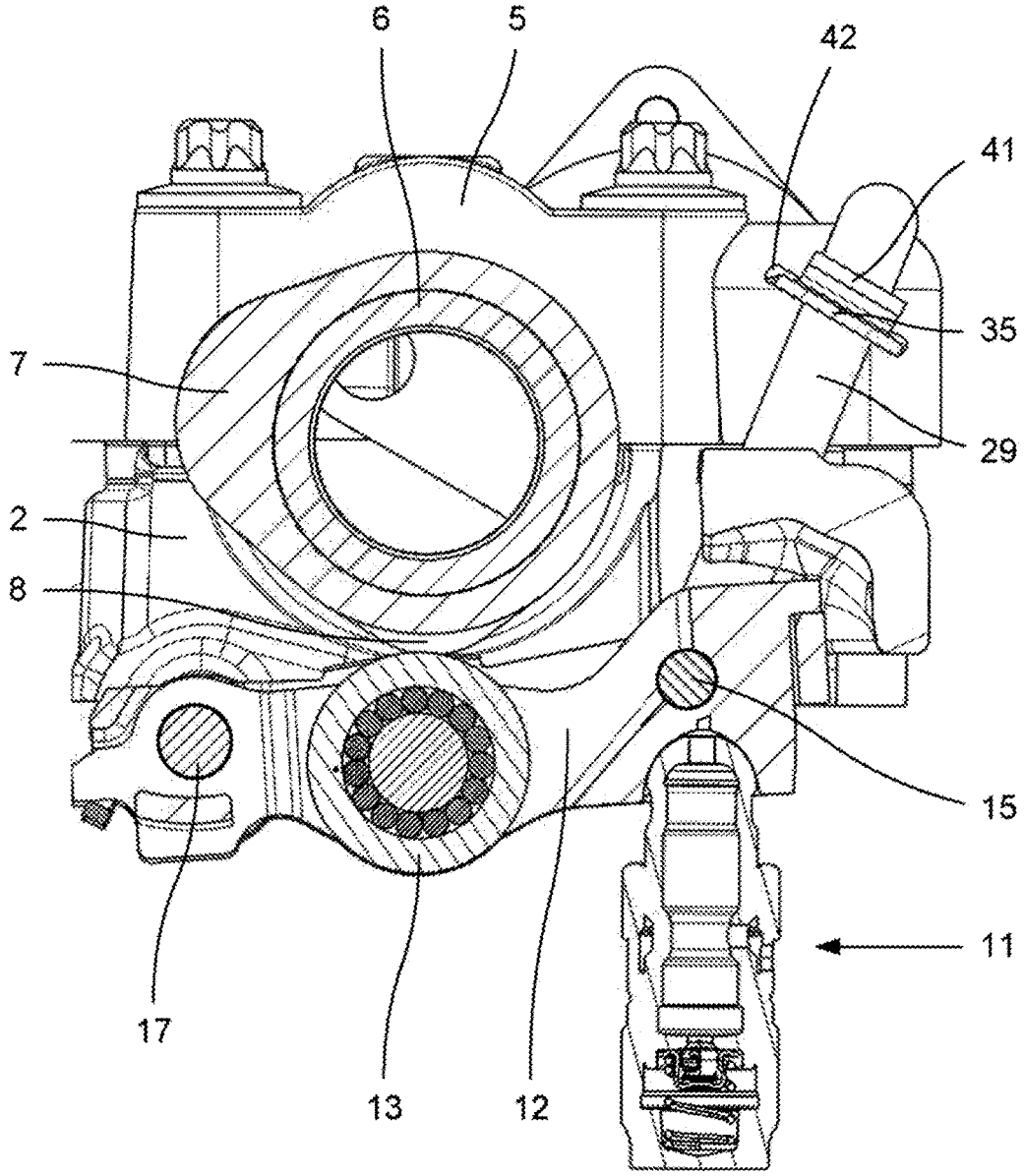
FIG. 2*d* shows a detail of the valve drive in FIG. 2 comprising a longitudinally sectioned view of a switchable finger follower in the state in which it is switched over.

This coupled switching state of a switchable finger follower 10, which is also illustrated in the lengthwise view in FIG. 2*b* and in which the coupling pin 15 is partially within the coupling hole 28 of the secondary lever 16, is particularly clearly visible in the cross-sectional view in FIG. 2*c*. In the coupled state of the primary lever 12 and of the secondary lever 16, the respectively higher lift curve of the relevant primary cam 7 or of the relevant secondary cam 8 is transmitted to the associated first exhaust valve via the primary lever 12 or via the secondary lever 16 and the primary lever 12 of the switchable finger follower 10 when the exhaust camshaft 6 rotates. This can be seen particularly clearly in the longitudinally sectioned view in FIG. 2*d*, in which the primary cam 7 of the exhaust camshaft 6 is currently being contacted by the roller 13 of the primary lever 12 on the base circle radius, and the secondary cams 8 of the exhaust camshaft 6 are currently being contacted by the sliding surfaces 20*a*, 20*b* of the web sections 19 of the secondary lever 16 in the region of an additional lift cam.

By switching on or switching off the linear actuator 32, the switching rod 35 of the actuating device 31 is pushed back into its rest position 43 under the action of the stressed helical spring 37, counter to the switching direction indicated by the direction arrow 44. As a result, the leaf springs 30 of the unlocking pins 25 are stressed in such a way that they impose an axial load on the unlocking pins 25 counter to the switching direction 44. As a result, the coupling pins 15 of those finger followers 10, the primary and secondary cams 7, 8 of which are currently being contacted on the base circle radius by the roller 13 of the primary lever 12 and the sliding surfaces 20*a, b* of the web sections 19 of the secondary lever 16 are immediately pushed back into the associated transverse hole 14 of the primary lever 12 by means of the respective leaf springs 30 and the relevant unlocking pins 25 since the coupling, locking and unlocking pins 15, 22, 25 are then free from transverse force. The secondary levers 16 of the relevant finger followers 10 are then decoupled from the associated primary levers 12.

In the case of those finger followers 10, the primary or secondary cams 7, 8 of which are currently being contacted outside the base circle radius by the roller 13 of the primary lever 12 or the sliding surfaces 20 of the web sections 19 of the secondary lever 16, there is initially only axial preloading of the unlocking pins 25 in the direction of the coupling pin 15 by means of the leaf springs 30. The relevant coupling pins 15 are then moved by means of the respective leaf springs 30 and the unlocking pins 25 into the transverse hole 14 of the primary lever 12 as soon as the primary and secondary cams 7, 8 associated therewith are being contacted on the base circle radius.

In comparison with an actuating arrangement that has separate hydraulic or electromagnetic actuators in or on the finger followers, the actuating device 31 according to the disclosure with the purely mechanically switchable finger followers 10 has a construction which is significantly simpler and saves more installation space and which can be produced at lower cost.

LIST OF REFERENCE CHARACTERS

1 valve drive
2 camshaft support
3 first sliding bearing section
4 second sliding bearing section
5 bearing cover
6 exhaust camshaft
7 primary cam
8 secondary cam
8 cam
10 switchable finger follower
11 supporting element
12 primary lever
13 contact element, roller
14 transverse hole
15 coupling element, coupling pin
16 secondary lever
17 pivot pin
18 contact pressure spring, leg spring
19 contact element, web section

20*a* first sliding surface on the secondary lever
20*b* second sliding surface on the secondary lever
21 transverse hole
22 locking pin
23 outer end of the locking pin
25 unlocking pin
26 outer end of the unlocking pin
28 coupling hole
29 first connection element, leaf spring
30 second connection element, leaf spring
31 actuating device
32 linear actuator, electromagnet
33 coil form
34 armature
35 switching rod, flat rod
36 angled, tab-shaped end of the switching rod
37 spring element, helical spring
38 wider outer side
39 opening
40 opening
41 spring clip
42 guide opening
43 rest position
44 direction arrow, switching direction
45 switching position
A axial spacing

The invention claimed is:

1. A variable valve drive of a combustion piston engine comprising:

at least one gas exchange valve per cylinder, a valve lift of the at least one gas exchange valve specified by a primary cam and at least one secondary cam of a camshaft and transmitted selectively to the at least one gas exchange valve via a switchable finger follower, the switchable finger follower including:

a primary lever supported on one end thereof by a supporting element and on another end thereof by a valve stem of the at least one gas exchange valve, the primary lever in contact with the primary cam, a secondary lever mounted pivotably on the primary lever, the secondary lever in contact with the at least one secondary cam and selectively coupled to the primary lever by a coupling pin configured to move within a transverse hole of the primary lever, the coupling pin movable: i) by a locking pin arranged in a transverse hole of the secondary lever to move the coupling pin in a first direction to engage a coupling hole of the secondary lever, and ii) by an unlocking pin arranged in the coupling hole of the secondary lever to move the coupling pin in a second direction to disengage the coupling hole, and a first axially outer end of the locking pin and a second axially outer end of the unlocking pin protrude out of the secondary lever, the first axially outer end coupled to a switching rod via a first rod-shaped connection element, and the second axially outer end coupled to the switching rod via a second rod-shaped connection element, the switching rod arranged above the finger follower, parallel to the camshaft, and longitudinally movable out of a rest position into a switching position against a restoring force of a spring element by a linear actuator.

2. The variable valve drive as claimed in claim 1, wherein the linear actuator is an electromagnet having an armature axially movable within a coil, and the armature is operatively connected to the switching rod.

3. The variable valve drive as claimed in claim 1, wherein the linear actuator is a single acting hydraulic or pneumatic actuating cylinder having a piston axially movable within the cylinder, the piston operatively connected to the switching rod.

4. The variable valve drive as claimed in claim 1, wherein the switching rod is designed as a flat rod with two wider outer sides, one of the two wider outer sides arranged to face the coupling pin of the switchable finger follower.

5. The variable valve drive as claimed in claim 4, wherein the switching rod is produced as a punched component from a steel sheet or a light metal sheet.

6. The variable valve drive as claimed in claim 1, wherein the first and second connection elements are configured as leaf springs, which are each rigidly secured on the respective first and second axially outer ends, and the first and second connection elements engage in respective first and second slot-shaped openings in the switching rod.

7. The variable valve drive as claimed in claim 6, wherein the first connection element is secured on the locking pin and the second connection element is secured on the unlocking pin by mounting and engagement of an open-ended hole arranged on the first and second connection elements that engages an annular groove arranged on the first and second axially outer ends.

8. The variable valve drive as claimed in claim 6, wherein an axial spacing of the first and second slot-shaped openings corresponds to an axial spacing between annular grooves in the locking pin and unlocking pin.

9. The variable valve drive as claimed in claim 8, wherein the switching rod includes an arcuate spring clip at the first slot-shaped opening for the first connection element, a free end of the spring clip projecting in a longitudinal direction within the first slot-shaped opening to provide elastic support for the first connection element.

10. The variable valve drive as claimed in claim 1, wherein the switching rod is guided and axially movable within a plurality of fixed guide openings of a cylinder head, and at least one of the plurality of fixed guide openings for the switching rod is arranged in a bearing cover of the camshaft.

11. The variable valve drive as claimed in claim 1, wherein the supporting element includes an integrated hydraulic valve lash compensating element.

12. A switchable finger follower for a variable valve drive of a combustion engine with at least one gas exchange valve having a valve lift specified by a primary cam and at least one secondary cam of a camshaft, the switchable finger follower comprising:

a primary lever having:

a first end configured to be supported by a supporting element, and a second end configured to be supported by one of the at least one gas exchange valve, and the primary lever configured to be in contact with the primary cam between the first and second ends, and a secondary lever mounted pivotably to the primary lever, the secondary lever configured to be in contact with the at least one secondary cam and selectively coupled to the primary lever by a coupling pin configured to move within a transverse hole of the primary lever, the coupling pin movable: i) by a locking pin arranged in a transverse hole of the secondary lever to move the coupling pin in a first direction to engage a coupling hole of the secondary lever, and ii) by an unlocking pin arranged in the coupling hole of the secondary lever to move the coupling pin in a second direction to disengage the coupling hole, and a first axially outer end of the locking pin and a second axially outer end of the unlocking pin protrude out of the secondary lever, the first axially outer end coupled to a switching rod, and the second axially outer end coupled to the switching rod, the switching rod arranged parallel to the camshaft and longitudinally movable from a rest position to a switching position.

13. A switchable finger follower for a variable valve drive of a combustion engine, the switchable finger follower comprising:

a primary lever, a secondary lever mounted pivotably on the primary lever, and a coupling assembly configured to selectively lock the secondary lever to the primary lever, the coupling assembly having:

a first axially outer end protruding out of the secondary lever, the first axially outer end configured to be connected to an actuator, and a second axially outer end protruding out of the secondary lever, the second axially outer end configured to be connected to the actuator.

14. The switchable finger follower of claim 13, wherein the first axially outer end protrudes out of a first longitudinal side of the secondary lever and the second axially outer end protrudes out of a second longitudinal side of the secondary lever.

15. The switchable finger follower of claim 13, wherein the coupling assembly further comprises:

a locking pin having the first axially outer end, the locking pin configured to move within a transverse hole of the secondary lever, an unlocking pin having the second axially outer end, the unlocking pin configured to move within a coupling hole of the secondary lever, and a coupling pin arranged in a transverse hole of the primary lever.

16. The switchable finger follower of claim 15, wherein the coupling pin is parallel to both the locking pin and the unlocking pin.

17. The switchable finger follower of claim 13, wherein:

the first axially outer end includes a first annular groove configured to connect the coupling assembly to the actuator, and the second axially outer end includes a second annular groove configured to connect the coupling assembly to the actuator.

18. The switchable finger follower of claim 13, wherein the secondary lever is pivotably mounted to the primary lever by a pivot pin arranged on a valve end of the switchable finger follower.

19. The switchable finger follower of claim 13, wherein the secondary lever includes at least one outer sliding surface configured to contact a secondary cam of a camshaft.

20. The switchable finger follower of claim 19, wherein the primary lever includes at least one roller configured to contact a primary cam of the camshaft.

* * * * *